United States Patent [19]

Hayashi et al.

[11] Patent Number: 5,005,818

[45] Date of Patent: Apr. 9, 1991

[54] SHEET FEED DEVICE HAVING A SHEET CASSETTE LOCKING MECHANISM

[75] Inventors: Takayuki Hayashi, Nagoya; Hideo Yoshihara, Kasugai, both of Japan

[73] Assignee: Brother Kogyo Kabushiki Kaisha, Japan

[21] Appl. No.: 452,413

[22] Filed: Dec. 19, 1989

[30] Foreign Application Priority Data

Dec. 21, 1988 [JP] Japan ..... 63-165921[U]
Jan. 25, 1989 [JP] Japan ..... 1-7490[U]

[51] Int. Cl.[5] ..... B65H 3/08

[52] U.S. Cl. ..... 271/107; 271/162; 221/154; 221/197; 221/287

[58] Field of Search ..... 271/107, 164, 162, 118, 271/117, 100, 11, 10; 221/154, 197, 287

[56] References Cited

U.S. PATENT DOCUMENTS 4,422,631 12/1983 Sugizaki ..... 271/164 X
4,427,192 1/1984 Kushmaul et al. ..... 271/107 X
4,591,140 5/1986 Illig et al. ..... 271/107 X
4,623,137 11/1986 Irie et al. ..... 271/164 X

FOREIGN PATENT DOCUMENTS 55-93744 7/1980 Japan .

*Primary Examiner*—David H. Bollinger
*Attorney, Agent, or Firm*—Oliff & Berridge

[57] ABSTRACT

A sheet feed device for feeding a sheet in a copying machine includes a sheet cassette storing a stack of sheets therein and removably positioned in a housing of the copying machine, and a plurality of suction cups for attracting one of the sheets at a time from the sheet cassette. The suction cups are movable toward and away from the sheet cassette. Locking fingers lock the sheet cassette against removal when the suction cups are moved toward the sheet cassette and are ready for or are feeding sheets from the sheet cassette. The locking fingers are angularly movably supported in the housing and lockingly fittable in recesses defined in side walls of the sheet cassette.

18 Claims, 5 Drawing Sheets

SHEET FEED DEVICE HAVING A SHEET CASSETTE LOCKING MECHANISM

BACKGROUND OF THE INVENTION

The present invention relates to a sheet feed device having suction cups for feeding a sheet in an image forming apparatus such as a copying machine, and more particularly to a lock mechanism for use with a sheet cassette in the image forming apparatus.

Sheet feed devices for separating and feeding sheets, one at a time, from a sheet stack generally include sheet feed rollers for supplying sheets through frictional engagement between the rollers and the uppermost sheet and also between stacked sheets. However, the sheet feed rollers may damage the sheets because of the friction, depending on the type of sheets used. Another sheet feed device includes suction cups for attracting sheets under vacuum, as disclosed in Japanese Laid-Open Patent Publication No. 55(1980)-93744, for example.

There is known a sheet feed device having a compact and simple mechanism for lifting and lowering suction cups to separate and feed sheets from a sheet cassette. The known mechanism includes an elevator arm supporting suction cups and a sheet sensor. When a sheet feeding cycle starts, the elevator arm is lowered until the sheet sensor detects the upper surface of the uppermost sheet of the sheet stack in the sheet cassette. When the sheet sensor detects the uppermost sheet, the elevator arm is stopped, and the suction cups are actuated to attract the sheet under vacuum.

As the number of sheets remaining in the sheet cassette is reduced, the elevator arm has to be lowered a longer distance. If the sheet cassette is removed while the elevator arm is in the lowered position, the sheet cassette may hit elements of the sheet feed mechanism such as the suction cups and damage them due to under forces applied to these sheet feed mechanisms.

SUMMARY OF THE INVENTION

In view of the aforesaid drawbacks of the conventional sheet feed devices, it is an object of the present invention to provide a sheet feed device having means for locking a sheet cassette against removal when a sheet feed mechanism is lowered, so that the sheet feed mechanism will not be damaged or broken by an attempt to remove the sheet cassette.

According to the present invention, there is provided a sheet feed device for feeding a sheet in a housing, comprising a sheet feed device for feeding a sheet in a housing, comprising a sheet cassette storing a stack of sheets therein and removably positioned in the housing, sheet attracting means for attracting one of the sheets from said sheet cassette, said sheet attracting means being movable toward and away from said sheet cassette, and locking means for locking said sheet cassette against removal from the housing in response to movement of said sheet attracting means toward said sheet cassette for feeding sheets from said sheet cassette.

The sheet cassette includes a side wall having a recess defined therein, and the locking means comprises a locking finger angularly movably supported in the housing and lockingly fittable in the recess.

While the sheet attracting means is moved toward the sheet cassette for feeding the sheets from the sheet cassette, the locking finger is fitted in the recess of the sheet cassette to lock the sheet cassette against removal from the housing. Therefore, the sheet attracting means, typically suction cups, and a mechanism for moving the sheet attracting means are not hit by the sheet cassette, and protected against damage or breakage which would otherwise result from engagement with the sheet cassette being removed.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
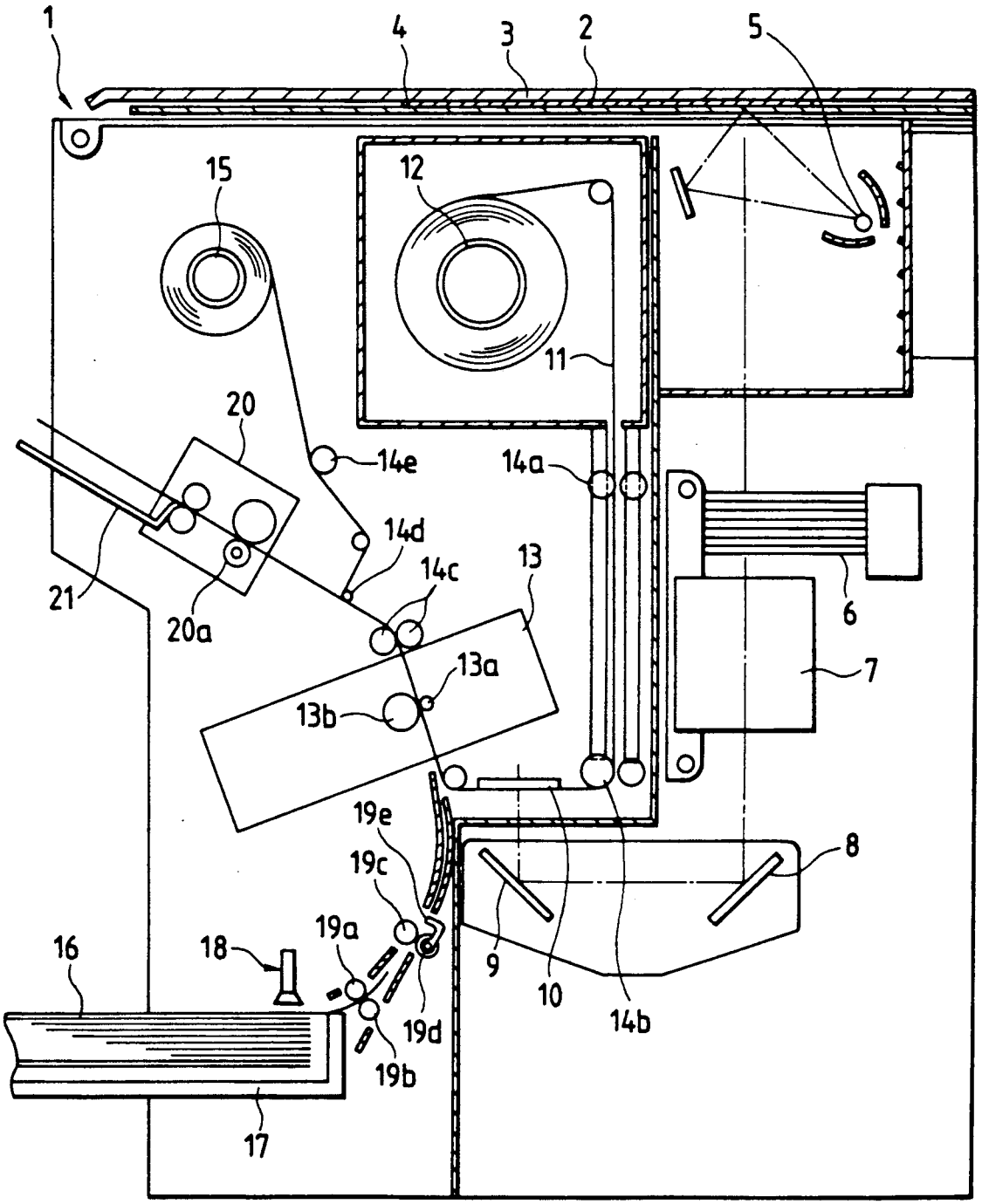
FIG. 1 is a schematic vertical cross-sectional view showing a copying machine incorporating a sheet feed device according to a first embodiment of the present invention.

FIG. 1 schematically shows a copying machine incorporating a sheet feed device according to an embodiment of the present invention. The illustrated copying machine, generally indicated at 1, comprises a photosensitive pressure-sensitive copying machine capable of copying full-color images.

The photosensitive pressure-sensitive copying machine 1 employs a continuous photosensitive pressure-sensitive recording medium such as a photosensitive microcapsule-coated recording sheet for recording a latent image thereon, and a color developer sheet for receiving a developed color image from the microcapsule-coated recording sheet.

The photosensitive pressure-sensitive copying machine 1 includes an upper panel assembly having a subject holder 2 of glass which is movable back and forth and a subject holder cover 3 that can be placed over the subject holder 2. A subject or original 4 to be copied is put on the subject holder 2.

The copying machine 1 also has a light source 5 placed in an upper righthand portion (FIG.5) thereof below the subject holder 2, the light sources 5 comprising a halogen lamp. The halogen lamp 5 radiates a linear light beam through a slit defined in an upper panel of a copying machine housing toward the subject holder 2. The light beam emitted from the halogen lamp 5 passes through the transparent subject holder 2, and is reflected by the subject 4 placed on the subject holder 2.

When the subject holder 2 moves, the light beam emitted from the halogen lamp 5 scans the subject 4 two-dimensionally. The light beam reflected by the subject 4 is directed downwardly and passes through a filter 6 and a lens 7. The light beam converged by the lens 7 is reversely directed by 180° degrees back by two reflecting mirrors 8, 9, and then focused on a microcapsule-coated recording sheet 11 held closely against the lower surface of an exposure plate 10. The reflecting mirrors 8, 9 are mounted on a mirror attachment which is slightly positionally adjustable to vary the length of the light beam path or the focused condition.

The microcapsule-coated recording sheet 11 is of a continuously elongated length and wound around a cartridge reel 12 which is placed in a removable cartridge removably installed in the copying machine housing. A leading end portion of the microcapsule-coated recording sheet 11 extends through a plurality of rollers 14*a*, 14*b*, 14*c*, a pressure developing unit 13, and a separator mechanism 14*d* toward a takeup reel 15. More specifically, the microcapsule-coated recording sheet 11 drawn out of the cartridge from its lower end is fed and guided by a feed roller 14*a* and a guide roller 14*b*, and extends beneath the exposure plate 10 into the pressure developing unit 13. The microcapsule-coated recording sheet 11 which has passed through the pressure developing unit 13 is fed by a pair of feed rollers 14*c*, travels past a separator roller 14*d* and a path adjustment roller 14*e*, and is then wound on the takeup reel 15. The microcapsule-coated recording sheet 11 discharged from the cartridge remains unexposed by a light-shielding cover before the recording sheet 11 reaches the exposure plate 10.

The speed at which the microcapsule-coated recording sheet 11 is fed is controlled so as to be held at a constant level, so that a latent image can be formed successively line by line on the microcapsule-coated recording sheet 11 when it moves past the exposure plate 10.

A color developer sheet cassette 17 storing a stack of color developer sheets 16 is disposed below the pressure developing unit 13. The sheet cassette 17 serves as an element of a sheet feed device of the present invention. One, at a time, of the color developer sheets 16 is taken out of the cassette 17 by a sheet feed mechanism 18 which attracts the color developer sheet 16 under suction. The color developer sheet 16 which is taken from the cassette 17 is delivered by a feed roller 19*a* and a pinch roller 19*b*. After a leading end of the color developer sheet 16 is positioned by rollers 19*c*, 19*d* and a resist gate 19*e*, the color developer sheet 16 is fed into an inlet slot of the pressure developing unit 13.

The microcapsule-coated recording sheet 11 and the color developer sheet 16 are closely held against each other when they are introduced into the pressure developing unit 13. More specifically, the microcapsule-coated surface of the recording sheet 11 which carries a latent image and the developer-coated surface of the color developer sheet 16 are held in contact with each other in the pressure developing unit 13. The pressure developing unit 13 includes a small diameter roller 13*a* and a backup roller 13*b*, by and between which the microcapsule-coated recording sheet 11 and the color developer sheet 16 are sandwiched and pressed together. At this time, those microcapsules on the microcapsule-coated surface which are not exposed are ruptured under pressure, and a developer image is transferred from the recording sheet 11 onto the color developer sheet 16.

The microcapsule-coated recording sheet 11 and the color developer sheet 16 which have left the pressure developing unit 13 are fed by the rollers 14*c*. Then, the microcapsule-coated recording sheet 11 is separated from the color developer sheet 16 by the separator roller 14*d*. The microcapsule-coated recording sheet 11 is directed upwardly, whereas the color developer sheet 16 travels straight ahead into a thermal fixing unit 20. The thermal fixing unit comprises a heater roller 20*a* which promotes color development on the color developer sheet 16 and fixes the color image on the color developer sheet 16. Thereafter, the color developer sheet 16 is discharged into a tray 21 with the developed image facing up. The separated microcapsule-coated recording sheet 11 travels past the path adjustment roller 14*e* and is then wound around the takeup reel 15.

The sheet feed device including the sheet feed mechanism 18 will be described in greater detail with reference to FIGS. 2 and 3.

The sheet feed mechanism 18 includes a pair of suction cups 31 mounted on an angularly movable elevator arm 32 by means of an attachment plate 32*a*. The elevator arm 32 has two pivot shafts 34 (one shown in FIG. 2) rotatably supported on elevator frames 36 vertically movably mounted on machine side plates 35 (one shown in FIG. 2). The pivot shafts 34 about which the suction cups 31 are angularly movable have their central axes lying on a plane which contains the suction surfaces of the suction cups 31. The pivot shafts 34 are positioned behind, or upstream of, the position where the suction cups 31 attract the color developer sheet 16, with respect to the direction in which the color developer sheet 16 is fed from the cassette 17.

The suction cups 31 are positioned such that they attract the color developer sheet 16 at its relatively forward portion in the direction of feed of the color developer sheet 16. An uppermost sheet sensor 33 which may comprise a microswitch, for example, is mounted on the elevator arm 32 by means of an attachment plate 32*b* extending from and inclined at an angle to the attachment plate 32*a*. When the attachment plate 32*b* extends vertically, the sensor 33 and the pivot shafts 34 are disposed in a common horizontal plane.

A motor 37 is mounted on one of the frames 36, and a gear 38 rotatable by the motor 37 is also supported on the frame 36. The gear 38 is held in mesh with a swing gear 39 fixed to the pivot shaft 34. Therefore, when the motor 37 is energized, the elevator arm 32 is angularly moved about the pivot shafts 34 in the directions indicated by the arrows A, B.

Each of the frames 36 is supported by a vertical guide mechanism (not shown), and can be moved vertically in the directions indicated by the arrows C, D by a step motor 40. Shafts 41, 42 mounted on the machine side plate 35 extend through respective vertical slots 43, 44 defined in the frame 36, and gears, 45, 46 fixed to the shafts 41, 42, respectively, are held in mesh with racks 47, 48 defined on edges of the slots 43, 44. A timing belt 51 is trained around pulleys 49, 50 fixed respectively to ends of the shafts 41, 42. A helical gear 52 fixed to the end of the shaft 41 is held in mesh with a worm gear 53 fixed to the output shaft of the step motor 40.

Each of the suction cups 31 has an inner hole defined in its bottom and connected through a flexible tube 54 to an evacuating means 55 mounted on the other machine side plate. The evacuating means 55 comprises a cylinder 56, a piston 58 having an O-ring 57 and slidably fitted in the cylinder 56, intermeshing gears 59, 60, and a step motor 61. When the step motor 61 is energized, the gear 60 mounted on the output shaft of the step motor 61 causes the gear 59 to rotate about a shaft 62. A pin 63 is disposed on the gear 59 near an outer peripheral surface thereof and fitted in a slot defined in one end of a piston rod 64 joined to the piston 58. Therefore, the gear 59 causes the piston 58 to move linearly in the cylinder 56 in the direction indicated by the arrow E, thereby developing a vacuum in the cylinder 56 which is connected to the tube 54.

Figure 2:
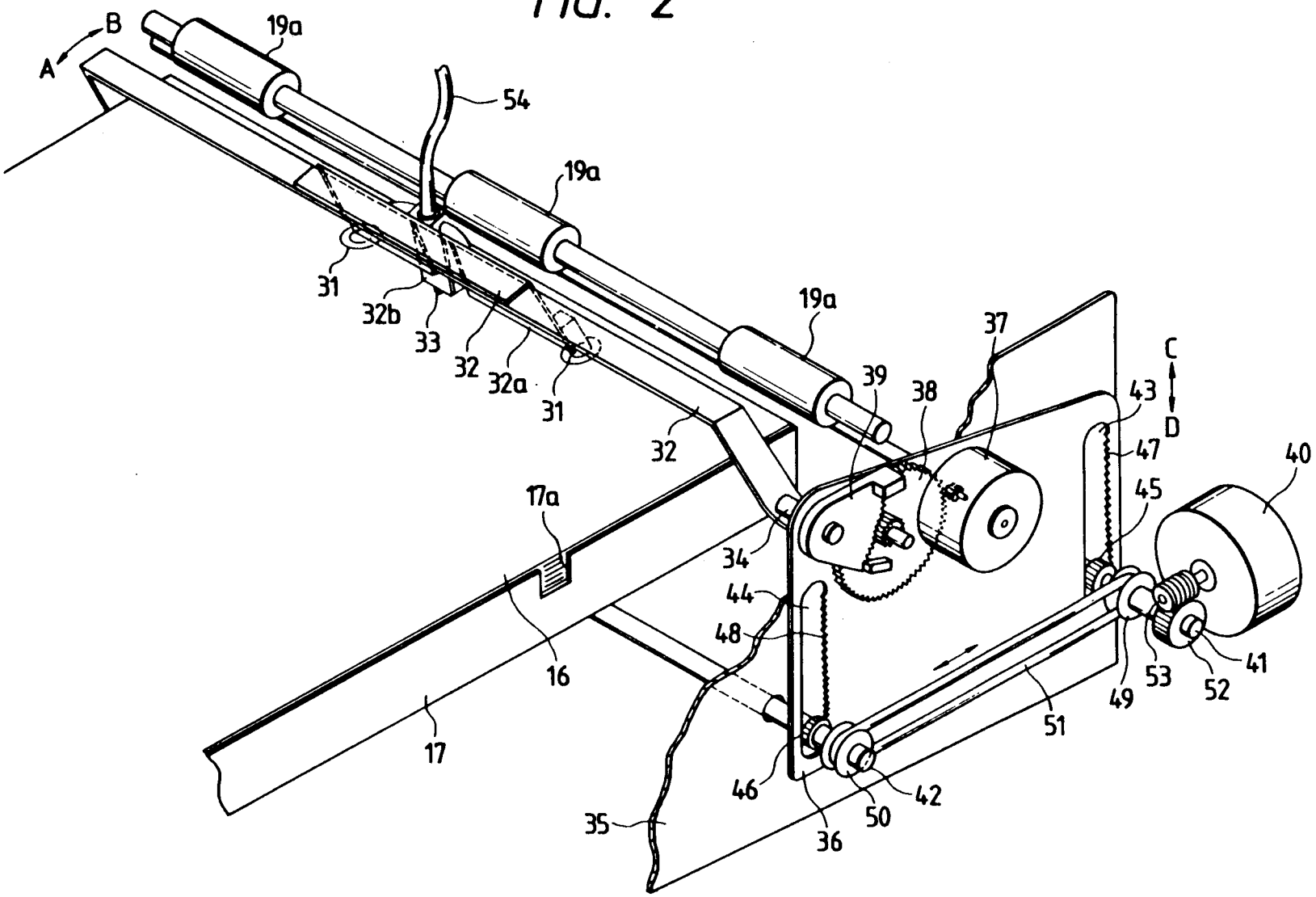
FIG. 2 is an enlarged fragmentary perspective view showing the sheet feed device according to the first embodiment.
Figure 3:
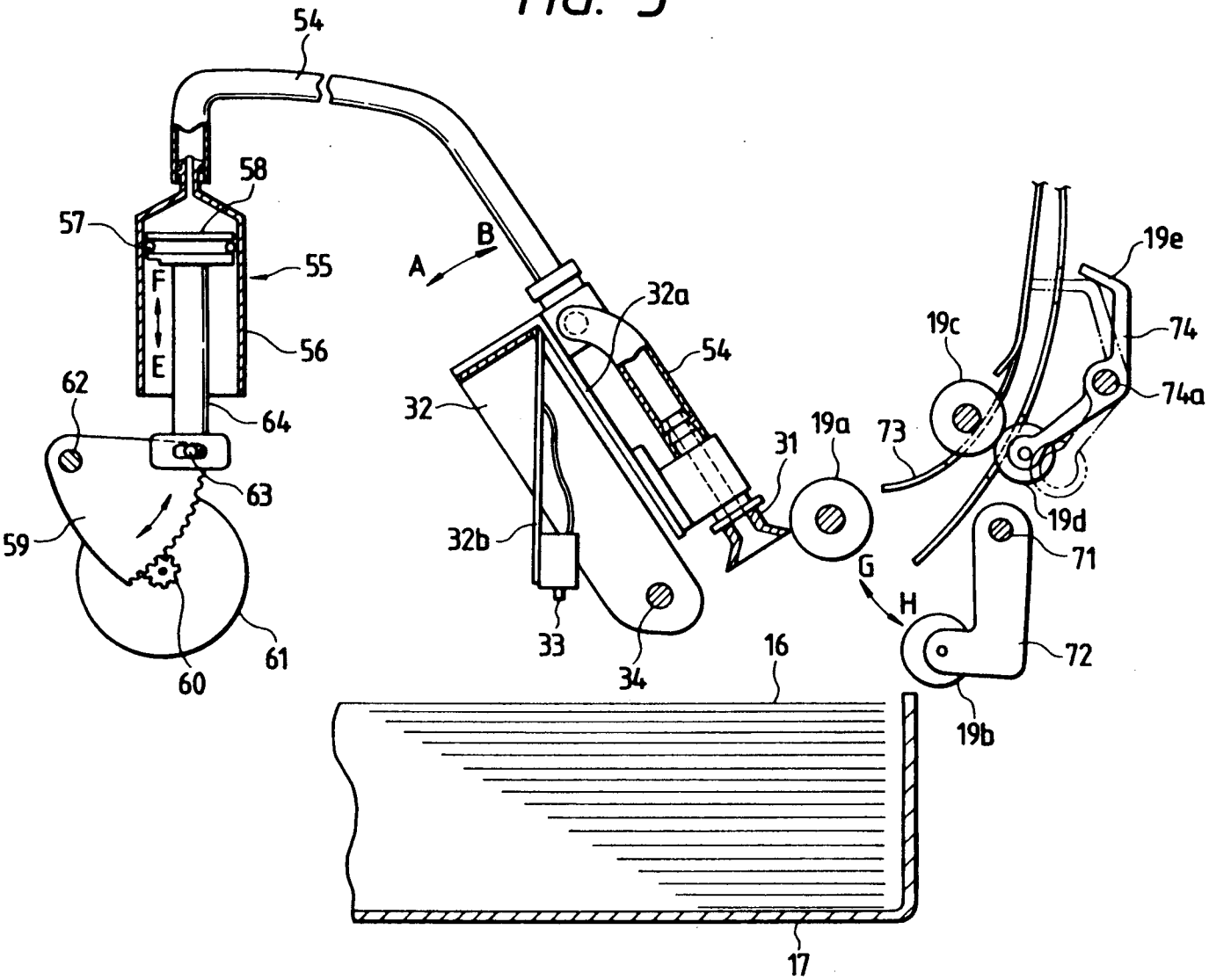
FIG. 3 is a side elevational view, partly cut away, showing the sheet feed device according to the first embodiment.

The feed roller 19*a*, which is shown as a plurality of feed rollers 19*a* in FIG. 2, is disposed upwardly of the leading ends of the color developer sheets 16 stacked in the cassette 17. The pinch roller 19*b* is movable toward and away from the feed roller 19*a* and rotatably supported on the distal ends of swing arms 72 (one shown in FIG. 3) which are angularly movable about a shaft 71 in the directions indicated by the arrows G, H. The swing arms 72 are angularly moved by a drive source (not shown) each time a color developer sheet 16 is to be fed out of the cassette 17, for thereby moving the pinch roller 19*b* toward and away from the feed roller 19*a*. A guide member 73 is disposed downstream of the rollers 19*a*, 19*b* with respect to the direction of feed of the color developer sheets 16, the guide member 73 defining a sheet feed path. The rollers 19*c*, 19*d* and the resist gate 19*e* are disposed in the guide member 73. The resist gate 19*e* comprises an end of a lever 74 rotatable about a shaft 74*a*. The roller 19*d* is supported on the other end of the lever 74. The roller 19*d* and the resist gate 19*e* are angularly movable alternatively between the solid-line position and the two-dot-and-dash-line position in FIG. 3.

Figure 4:
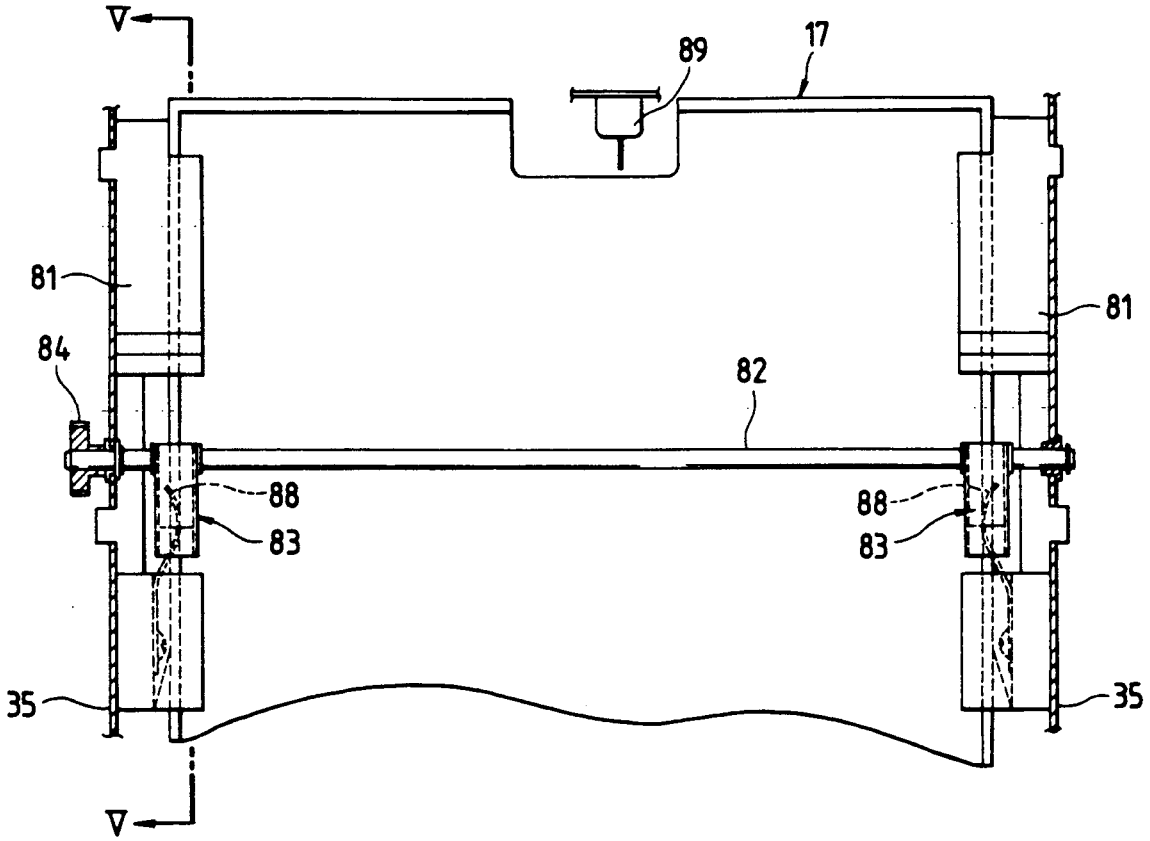
FIG. 4 is a fragmentary plan view showing a lock mechanism for a sheet cassette in the sheet feed device accoding to the first embodiment.
Figure 5:
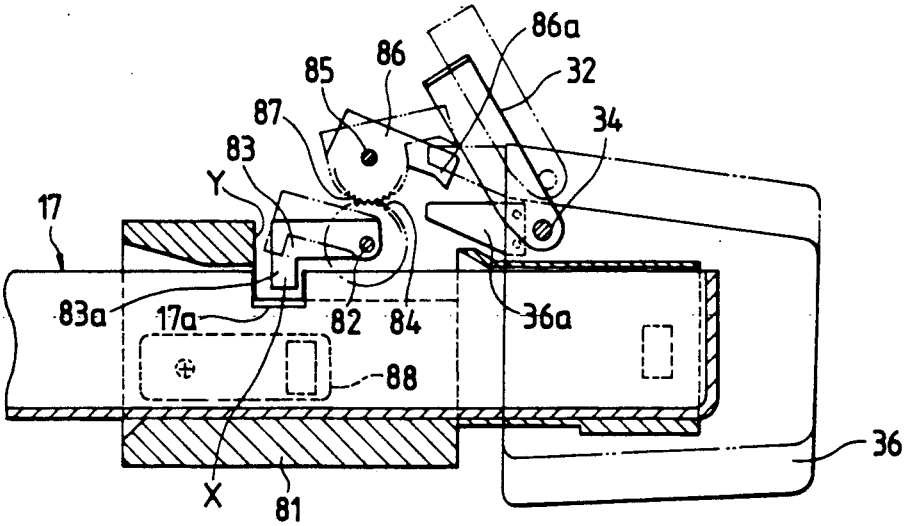
FIG. 5 is a cross-sectional view taken along line V—V of FIG. 4.

A lock mechanism of the sheet feed device will be described below with reference to FIGS. 4 and 5. To the side plates 35, there are attached respective cassette receivers 81 for receiving the sheet cassette 17, the cassette receivers 81 being in the form of resin moldings. The cassette receivers 81 are omitted from illustration in FIG. 2. The sheet cassette 17 is removably inserted into the cassette receivers 81. The sheet cassette 17 has a pair of locking steps or recesses 17*a* (referred to as "locking portion" or "locking face" in claims )defined in the upper edges of lateral side walls, respectively, thereof.

Locking fingers 83 (referred to as "locking means" or "locking member" in claims) having a locking projection 83*a*, are fixedly mounted on a shaft 82 which is rotatably supported on and extending between the side plates 35. The sheets cassette 17 is locked in place against removal when the locking fingers 83 are fitted in the respective recesses 17*a*. The locking fingers 83 are angularly movable, so that the locking projection 83*a* is movable into and out of the recesses 17*a* in response to vertical angular movement of the elevator arm 36.

More specifically, a gear 84 is fixedly mounted on one end of the shaft 82. The gear 84 is held in mesh with a gear 87 mounted on a cam 86 rotatably supported on a shaft 85 mounted on the side plate 35 (which is shown on the lefthand side in FIG. 4). The cam 86 has an arm portion 86*a* engageable with a tongue 36*a* attached to the elevator frame 36. When the elevator frame 36 is lowered as indicated by the solid line in FIG. 5, the tongue 36*a* is displaced out of engagement with the arm portion 86*a* of the cam 86. The locking fingers 83 are now turned by rotation of the cam 86 into the respective recesses 17*a* of the sheet cassette 17, thus locking the sheet cassette 17 against removal. Conversely, when the elevator arm 36 is lifted as indicated by the two-dot-and-dash line in FIG. 5, the arm portion 86*a* of the cam 86 is engaged by the tongue 36*a* and angularly moved thereby, causing the intermeshing gears 86, 74 to rotate the shaft 82 clockwise (FIG. 5) about its own axis. The locking fingers 83 are turned upwardly out of the recesses 17*a*, thereby unlocking the sheet cassette 17.

Each of the cassette receivers 81 has a leaf spring 88 on a cassette guide surface thereof, for positioning the sheet cassette 17. A microswitch 89 (FIG. 4) for detecting when the sheet cassette 17 is inserted in place is mounted in the copying machine housing at a position in front of the sheet cassette 17 as it is inserted.

When the elevator frame 36 is lowered for feeding a sheet from the sheet cassette 17, the sheet cassette 17 is locked by the lock mechanism against removal. Therefore, the sheet cassette 17 cannot be removed, and the suction cups 31 or the like are not hit or damaged by the side walls of the sheet cassette 17.

A lock indicator arm (not shown) may be operatively connected to one of the locking fingers 83, such that when the sheet cassette 17 is locked in position, the lock indicator arm can be brought into an operative position indicating to the user that the sheet cassette 17 is locked.

Figure 6:
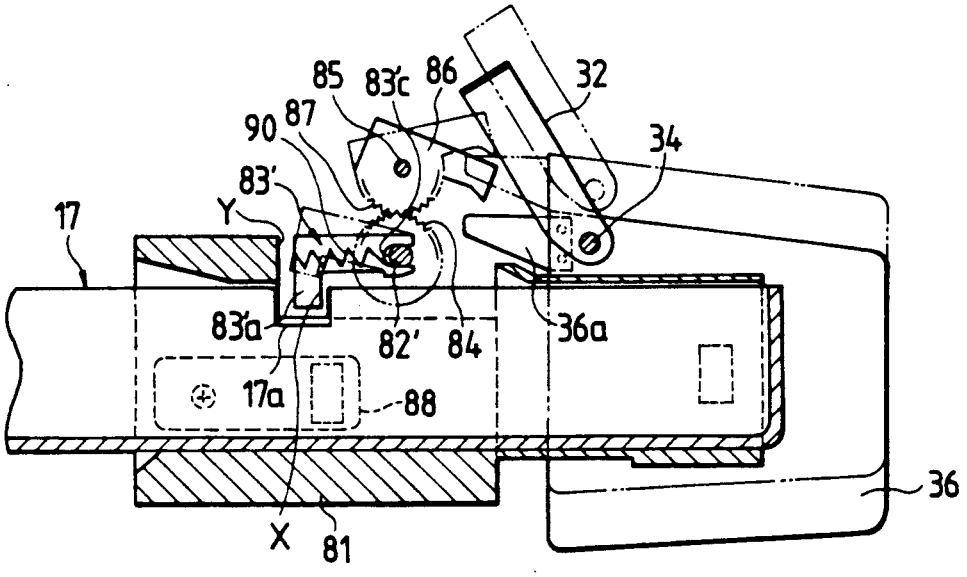
FIG. 6 is a cross-sectional view showing a sheet feed device according to a second embodiment of the present invention.
Figure 7:
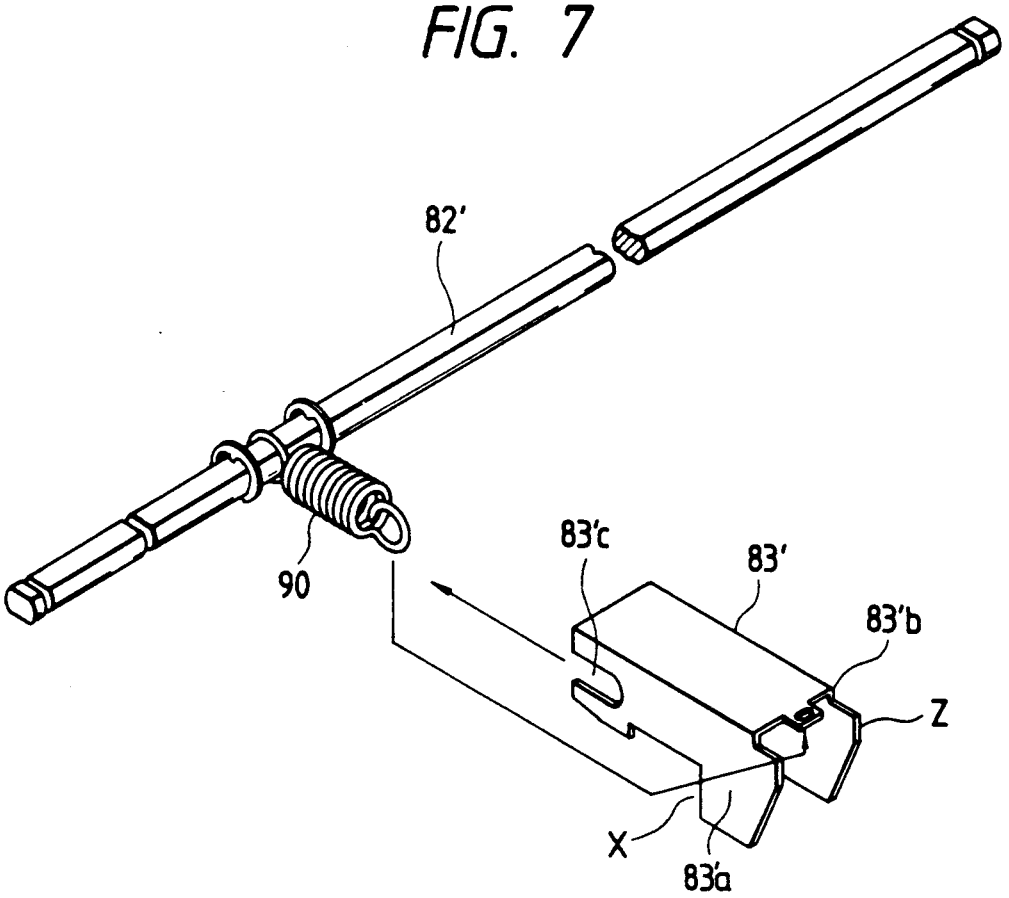
FIG. 7 is an exploded perspective view of a structure for supporting a locking finger of a lock mechanism according to the second embodiment.

FIGS. 6 and 7 show a locking finger supporting structure in a lock mechanism according to another embodiment of the present invention.

In FIG. 7, a locking finger 83' has slots 83'*c* (one shown) defined in an end thereof about which the locking finger 83' is angularly movable and two faces X and Z. The slots 83'*c* are slidably fitted over a shaft 82' of a rectangular cross section, with the upper and lower flat surfaces of the shaft 82' engaging the upper and lower edges of the slots 83'*c* . A tension spring 90 is coupled between the shaft 82' and a spring retainer 83'*b* of the locking finger 83'.

Operation of the lock mechanism of FIGS. 6 and 7 will be described with reference to FIGS. 6 and 7.

If a force is applied to pull out the sheet cassette 17 while the locking projection 83'*a* of the locking fingers 83' are being fitted in the respective recesses 17*a* (FIG. 6), then locking faces of the recesses 17*a* push the confronting faces X of the locking fingers 83'. Each of the locking fingers 83' is then slid against the resiliency of the spring 90 until the other face Z of the locking finger 83' engages a stopper Y of the cassette receiver 81. Therefore, the locking finger 83' is pinched between the stopper Y and the locking face of the recess 17*a*, with the result that the sheet cassette 17 is firmly locked against removal.

Since each of the locking fingers 83' is slidable in the embodiment shown in FIGS. 6 and 7, the recesses 17*a* and the stopper Y may be of lower dimensional accuracy, and can be designed and fabricated with greater ease.

In each of the illustrated embodiments, two locking fingers 83' or 83 are mounted on the shaft 82' or 82. However, only a single locking finger may be mounted on the shaft 82' or 82.

With the present invention, as described above, the sheet cassette is locked against removal by the lock mechanism which can be operated in response to downward movement of the sheet feed mechanism for feeding a sheet from the sheet cassette. Since the sheet cassette cannot be removed while a sheet is being taken out of the sheet cassette, therefore, the suction cups or other members of the sheet feed mechanism are prevented from damage or breakage which would otherwise be caused by inadvertent removal of the sheet cassette during sheet feeding operation.

Although certain preferred embodiments have been shown and described, it should be understood that many changes and modifications may be made therein without departing from the scope of the appended claims.

What is claimed:

1. A sheet feed device for feeding a sheet in housing, comprising:

a sheet cassette storing a stack of sheets therein and removably positioned in the housing;

sheet attracting means for attracting one of the sheets from said sheet cassette, said sheet attracting means being movable toward and away from said sheet cassette; and locking means for locking said sheet cassette against removal from the housing in response to movement of said sheet attracting means toward said sheet cassette for feeding sheets from said sheet cassette.

2. A sheet feed device according to claim 1, wherein said sheet cassette includes a locking portion having a locking face, said locking means comprising a locking member movably supported in said housing, said locking member having an engaging position engageable with the locking face and non-engaging position spaced away from the locking face.

3. A sheet feed device according to claim 2, wherein said sheet cassette is removable in a first direction from said housing, said locking member having a first face engageable with said locking face of said locking portion to lock said sheet cassette against removal when the sheet cassette is pulled in said first direction while said locking member is in the engaging position.

4. A sheet feed device according to claim 3, further comprising driving means for driving said sheet attracting means vertically toward and away from the sheet stored in said sheet cassette.

5. A sheet feed device according to claim 4, wherein said locking means includes means for moving the locking member, the moving means being in synchronism with the movement of the sheet attracting means.

6. A sheet feed device according to claim 5, wherein said moving means for moving the locking member is capable of moving the locking member angularly.

7. A sheet feed device according to claim 6, further comprising a pair of side plates provided in the housing and an elevator fram movably supported by at least one side plate for moving the sheet attracting means, means for moving said elevator frame, and wherein an angularly moving means comprises a tongue fixed to the elevator frame;

a cam rotatably supported by the housing, the cam having a gear portion and an arm portion engageable with the tongue;

a shaft rotatably supported by the pair of said plates, the locking member being connected to the shaft;

a gear wheel fixedly mounted on the shaft and meshedly engaged with the gear portion.

8. A sheet feed device according to claim 7, wherein said sheet cassette includes a side wall formed with a recess, said locking face being provided by the recess, said locking member being composed of a locking finger movably supported in said housing and lockingly fittable in said recess.

9. A sheet feed device according to claim 2, wherein said sheet cassette is removable in a first direction from said housing, said locking member of the said locking means being slidably in said first direction, said locking member having a first face engageable with said locking face of said locking portion to lock said sheet cassette against removal when the sheet cassette is pulled in said first direction while said locking member is at the engaging position.

10. A sheet feed device according to claim 9, wherein the locking member has a second face opposite the first face in the first direction, and further comprising;

a spring acting between said housing and said locking member for normally urging said locking member to move in a second direction opposite to said first direction, and a cassette stop member provided in the housing, and engageable with the second face of said locking member when the cassette is pulled in the first direction.

11. A sheet feed device according to claim 10, further comprising driving means for driving said sheet attracting means vertically toward and away from the sheet stored in said sheet cassette.

12. A sheet feed device according to claim 11, wherein said locking means includes means for moving the locking member, the moving means being in synchronism with the movement of the sheet attracting means.

13. A sheet feed device according to claim 12, wherein said moving means for moving the locking member is capable of moving the locking member angularly.

14. A sheet feed device according to claim 13, further comprising a pair of side plates provided in the housing and an elevator frame movably supported by at least one side plate for moving the sheet attracting means, means for moving the elevator frame, and wherein an angular moving means comprises a tongue fixed to the elevator frame;

a cam rotatably supported by the housing, the cam having a gear portion and an arm portion engageable with the tongue;

a shaft rotatably supported by the pair of side plates, the locking member being connected to the shaft;

a gear wheel fixedly mounted on the shaft and meshedly engaged with one gear portion.

15. A sheet feed device according to claim 14, wherein said sheet cassette includes a side wall formed with a recess, said locking face being provided by the recess, said locking member being composed of a locking finger movably supported in said housing and lockingly fittable in said recess.

16. A sheet feed device according to claim 15, wherein the shaft has a rectangular cross-section, and wherein the locking finger is formed with a slot extending in a direction parallel with the first direction, the locking finger being slidably mounted with respect to the rectangular shaft, and wherein the spring has one end connected to the rectangular shaft and another end connected to the locking finger.

17. A sheet feed device according to claim 10, wherein said housing comprises a cassette receiver for receiving said cassette, said cassette receiver providing said cassette stop member.

18. A sheet feed device according to claim 1, wherein said attracting means comprises a mechanism for attracting and releasing the sheet by controlling an pneumatic pressure acting on the sheet.

* * * * *